United States Patent [19]

Hukuba et al.

[11] 3,958,297

[45] May 25, 1976

[54] SUCTION CLEANER

[75] Inventors: Hiroshi Hukuba, Nagareyama; Iwao Ikegami, Ichikawa; Teruaki Yasuda, Tokorozawa, all of Japan

[73] Assignee: Kabushiki Kaisha Hukuba Future Research, Nagareyama, Japan

[22] Filed: Apr. 17, 1974

[21] Appl. No.: 461,783

[30] Foreign Application Priority Data

Apr. 28, 1973 Japan ..... 48-48870

[52] U.S. Cl. ..... 15/315; 15/323; 15/377; 254/175.5

[51] Int. Cl.[2] ..... A47L 5/38

[58] Field of Search ..... 15/315, 323, 377; 226/118, 181; 254/175.5

[56] References Cited

UNITED STATES PATENTS

| | | | |
|---|---|---|---|
| 2,023,955 | 12/1935 | Harvey | 15/315 |
| 2,051,728 | 8/1936 | Manning | 15/315 X |
| 2,670,926 | 3/1954 | Sewell et al. | 254/175.5 |
| 3,619,851 | 11/1971 | Bolzan et al. | 15/315 UX |

FOREIGN PATENTS OR APPLICATIONS

| | | | |
|---|---|---|---|
| 271,092 | 1/1951 | Switzerland | 15/315 |
| 1,235,380 | 5/1960 | France | 15/315 |

*Primary Examiner*—Robert W. Jenkins
*Assistant Examiner*—C. K. Moore
*Attorney, Agent, or Firm*—Woodhams, Blanchard and Flynn

[57] ABSTRACT

A suction cleaner, wherein the interior of a container thereof is divided into two chambers, namely, the first chamber and the second chamber, by a partition, and the first chamber accommodates a suction fan, a filter member and a dust-receiving box installed therein while the second chamber randomly stores a suction hose, the rear end of said hose being rotatably supported within an opening provided in said partition while the front end of said hose projects out of an opening provided on one side of said container; a device for the paying-out and hauling-in of the hose is installed adjacent the inside of said opening provided on the container; lead wires are provided for the hose along the whole length thereof, the front end of said lead wires being connected with a switch mounted on the hose while the rear end of the same being connected with a ring contact provided on the hose; said movable contact is devised to be in touch with a fixed contact provided on the partition; and said fixed contact is connected with the controlling circuits of the driving power sources.

5 Claims, 3 Drawing Figures

SUCTION CLEANER

BACKGROUND OF THE INVENTION

The present invention relates to a suction cleaner. One well-known suction cleaner has a construction wherein the interior of a container is divided into two chambers by a partition; one chamber accommodating a suction fan, filter member and a dust-receiving box installed therein and the other chamber accommodating a rotating drum to wind a suction hose therearound it; the rear end of said hose is fixed on said partition so as to open therethrough while the front end of the hose is allowed to stick out of the chamber; and a pair of rotating rollers driven by a motor are provided for the purpose of holding said hose therebetween as well as paying it out from or hauling it into the container by virtue of their rotation.

However, a suction cleaner of this type has a drawback that not only its construction is intricate because of the provision of said rotating drum but also it is difficult to smoothly wind the hose around said rotating drum.

Moreover, a suction cleaner of this type has another drawback that, inasmuch as the rear end of the hose is fixed on the partition, due to the twisting force arising from the hauling of the hose into the container, the hose tends to get intertwined and, in an extreme case, it is tied into a bundle, rendering it very difficult or impossible to pay it out of the chamber.

One object of the present invention is to overcome the foregoing drawbacks of the conventional suction cleaners and to provide an improved suction cleaner which can accommodate the hose by letting it fill the chamber therefor at liberty without resorting to the provision of a rotating drum for winding it and facilitate the hauling-in of the hose despite the simple construction thereof.

Another object of the present invention is to provide an improved suction cleaner which overcomes the drawbacks of the conventional suction cleaners and is so devised that the rear end of the hose is rotatably fixed to the partition so as to open therethrough and the twisting force arising from the hauling of the hose into the container is relieved by turning the rear end of the hose on the partition along the direction of said twisting force, whereby the hose is prevented from getting intertwined within the container and the paying-out of the hose can be performed smoothly.

A further object of the present invention is to provide a suction cleaner, wherein the lead wires are provided for the hose along the whole length thereof, the front end of said lead wire being connected with a switch mounted on the hose and the rear end of the same being connected with a movable contact provided on the hose, said movable contact being devised to be in contact with a fixed contact provided on the partition, said fixed contact being connected with the controlling circuits of a motor for driving the suction fan and a motor for driving the member for paying out and hauling in the hose, and these motors being driven through remote control by means of a switch.

The present invention will be explained more particularly with reference to the accompanying drawings.

BRIEF DESCRIPTION OF THE DRAWINGS

In the accompanying drawings.

DETAILED DESCRIPTION OF THE INVENTION

Figure 1:
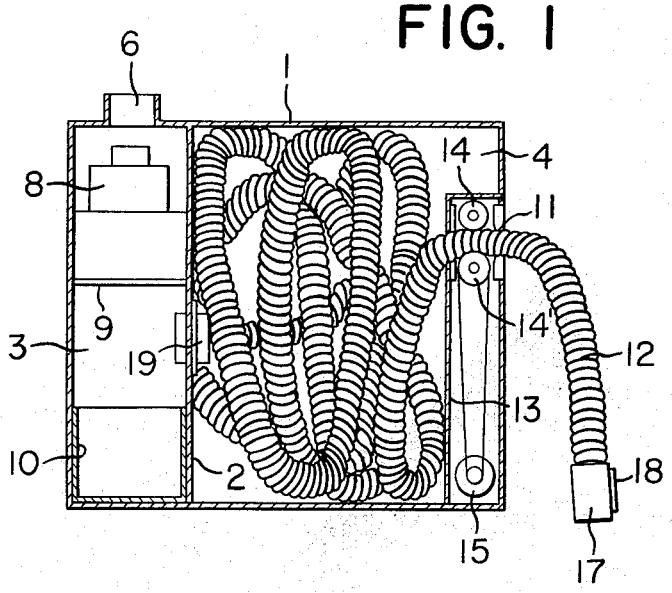
FIG. 1 is a front view of the vertical section of a part of an apparatus embodying the present invention.

Referring to FIG. 1, 1 denotes a container, whose interior is divided into a first chamber 3 and a second chamber 4 by a partition 2, said partition 2 being provided with the opening 5 through which said two chambers are interconnected.

The top of the chamber 3 is provided with the exhaust hole 6, and below said exhaust hole 6 there is installed the suction fan 8 with the motor 7. The inlet port side of this suction fan 8 is provided with the filter 9, and below said filter 9 there is placed the dust-receiving box 10 which can be freely taken in and out.

The side wall of the chamber 4 is provided with the opening 11 through which the hose 12 being accommodated in said chamber 4 can be paid out or hauled in. Adjacent the inside of the opening 11, there is installed the supporting frame 13, and on this supporting frame 13 are pivoted a pair of rotating rollers 14 and 14′ which are disposed above and below the hose 12 so as to hold it therebetween and are devised to rotate in opposite directions. These rollers 14 and 14′ are interlocked and one roller 14′ is so devised as to be selectively rotated both clockwise and anticlockwise by means of the reversible motor 15 installed in the chamber 4.

The hose 12 consists of a couple of helical lead wire 16 and 16′ disposed parallel to each other and having their exterior surrounded with a flexible covering film, the front end of said hose 12 being provided with the coupling 17 for the purpose of connecting with a suction pipe not shown in the drawing while the rear end of the same being rotatably connected with the partition 2 at the opening 5 thereon. The coupling 17 is equipped with the normally open switch 18 which is connected with the front ends of the lead wires 16 and 16′.

Figure 2:
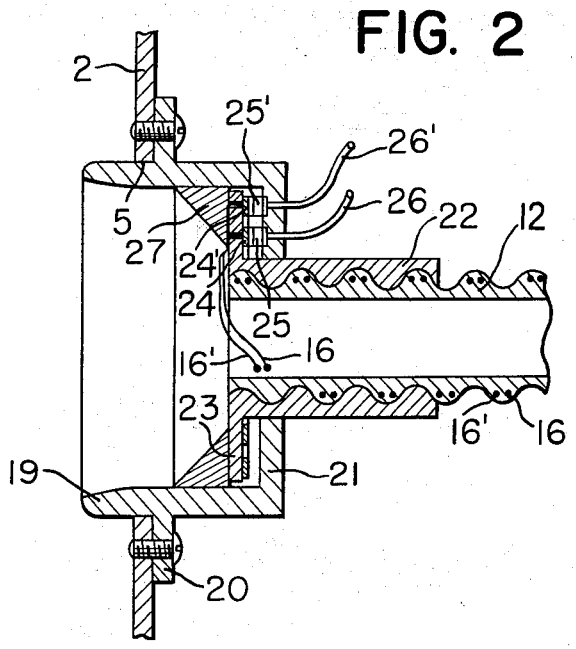
FIG. 2 is a vertical section — on an enlarged scale — of the essential part of the same apparatus as shown in FIG. 1; and, FIG. 3 is a diagrammatic representation of the controlling circuits within the apparatus shown in FIG. 1.

FIG. 2 is illustrative of the state of connection between the partition 2 and the hose 12. That is, a cylindrical portion of a cylindrical receiving member 19 is inserted in the opening 5 and is fixed to the partition 2 by means of the ring flange 20 provided on the outer surface of said cylindrical portion. In the opening provided on the end wall 21 of the cylindrical receiving member 19, there is rotatably inserted the cylindrical portion of the cylindrical supporting member 22, and the end of said cylindrical portion of the supporting member 22 within the receiving member 19 is provided with the ring seat 23, and on the surface of one side of said ring seat 23 confronting the inner side of the end wall 21 there are fixed the ring contact plates 24 and 24′. Meanwhile, the inner surface of the supporting member 22 is provided with a female screw profile of the same pitch as that of the helix of the hose 12, so that the rear end of the hose 12 can be screwed in the supporting member 22, and the rear ends of the lead wires 16 and 16′ are connected with the ring contact plates 24 and 24′ respectively. And, in order to prevent the supporting member 22 from moving toward the chamber 3, the stop ring 27 is provided on the back of the ring seat 23. On the inside of the end wall 21, there are provided the resilient contacts 25 and 25′ disposed to confront the contact plates 24 and 24′ respectively, and the lead wires 26 and 26′ are connected with said contact plates 25 and 25' respectively.

Figure 3:
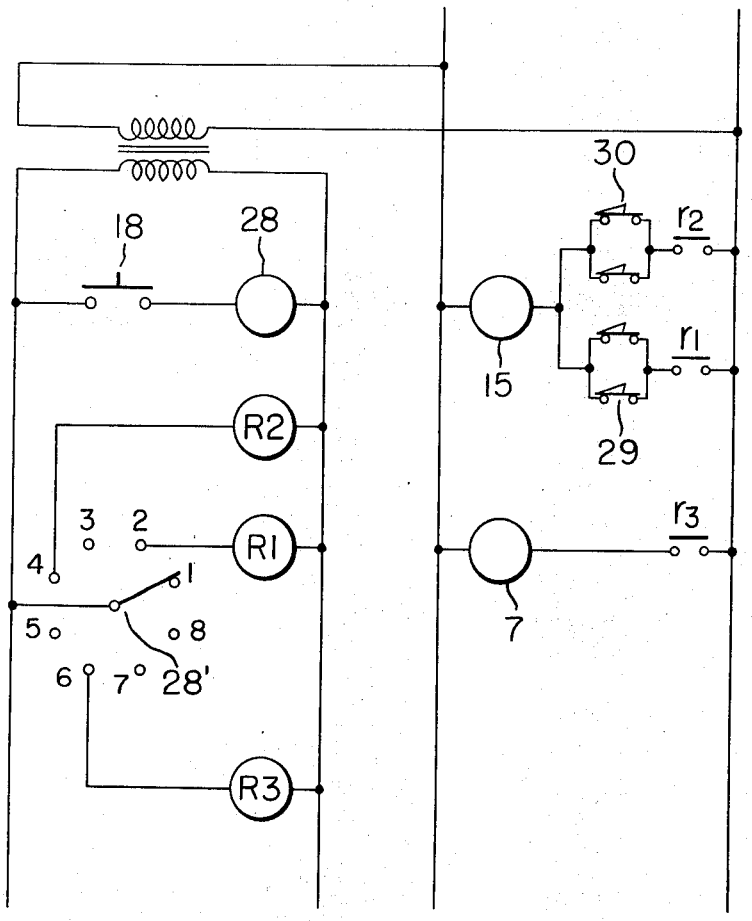
Figure 3:
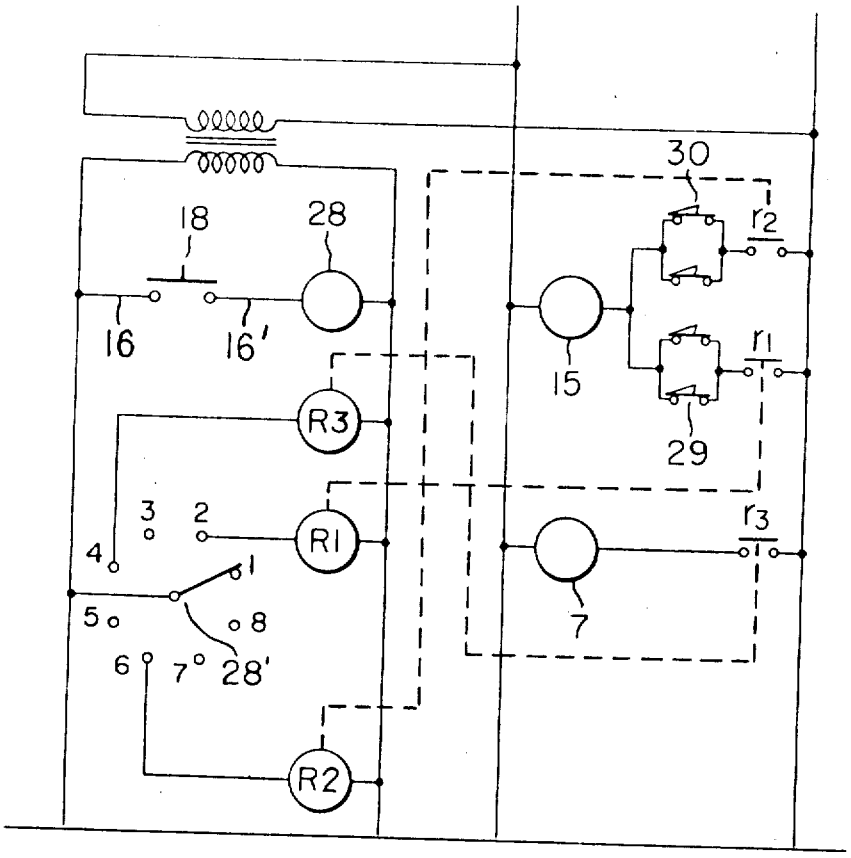

FIG. 3 shows a typical controlling circuit to be applied to the present invention. In the drawing, 28 denotes a stepping relay coil and 28' denotes the stepping relay switch which is actuated through the excitation of the step coil 28, both of which are commonly known. $R_1$ and $R_2$ denote the relay coils which actuate the relay switch $r_1$ for the normal rotation and the relay switch $r_2$ for the reverse rotation of the motor 15, respectively, and $R_3$ denotes the relay coil for actuating the relay switch $r_3$ for the motor 7 to drive the fan 8. 29 and 30 denote microswitches, and they are connected with the relay switches $r_1$ and $r_2$, respectively. These microswitches 29 and 30 are so devised that they are normally closed and are to open only when they are engaged with a push ring (not shown in the drawing) provided on the hose 12 for controlling the length of hose paid out or hauled in respectively. The microswitches 29 and 30 and the actuation thereof by push rings on the hose is disclosed in detail in our copending application Ser. No. 456,461, filed Apr. 1, 1974.

Hereunder will be explained how to operate the above described apparatus.

The hose 12 is usually accommodated in the chamber 4 of the container 1 as shown in FIG. 1. In order to pay out the thus accommodated hose 12 to the extent of a desired length, the step coil 28 and the stepping relay 28' are actuated by closing the switch 18. Closing of switch 18 energizes coil 28, which then causes the switch 28' to automatically advance one step so as to engage contact No. 2. The relay coil $R_1$ is thus energized and closes the relay switch $r_1$, the motor 15 starts rotating in the normal direction, and the rotating rollers 14 and 14' rotate in the normal direction, respectively, whereby the hose held between said rollers is paid out from the container 1. When a desired length of the hose has been paid out, either the switch 18 is opened to deenergize coil $R_1$ so that switch $R_1$ opens, or the push ring (not shown in the drawing) provided on the hose 12 engages and opens the microswitch 29, whereby the rotation of the motor 15 is discontinued. When switch 18 is opened, coil 28 is deenergized so that switch 28' is automatically advanced one step so as to engage contact No. 3.

By again closing switch 18, coil 28 is energized and switch 28' automatically advances one step to contact No. 4. Coil $R_3$ is thus energized and relay switch $r_3$ is closed to rotate the motor 7, whereby the suction fan 8 is actuated to suck in the dust-containing air current through the suction pipe (not shown in the drawing) fixed to the coupling 17 equipped on the front end of the hose 12 and lead it into the chamber 3 through the receiving member 19. The dust is filtered by the filter 9 to fall into the dust-receiving box 10, and the purified air after the filtration is discharged to the outside through the exhaust hole 6. The dust accumulated in the dust-receiving box 10 is disposed of upon removing the box from the container 1.

When the cleaning of a desired place has been completed in this way, the switch 18 is again operated, being first opened to deenergize coil 28, whereby switch 28' advances to contact No. 5. Switch 18 is then closed to energize coil 28 and advance switch 28' to contact No. 6. Relay coil $R_2$ is thus energized so that switch $r_2$ is closed to rotate the motor 15 in the reverse direction, and by virtue of the reversed rotation of the rotating rollers 14 and 14', the hose 12 is hauled into the container 1. When the hose 12 has been accommodated in the container 1, the push ring (not shown in the drawing) provided on the hose 12 engages and opens the microswitch 30 and discontinues the rotation of the motor 15.

Although a particular preferred embodiment of the present invention has been disclosed hereinabove for the purpose of illustration, it will be understood that variations and modifications thereof which lie within the scope of the invention as defined by the appended claims are fully contemplated.

What is claimed is:

1. In a suction cleaner, the combination comprising:

housing means defining an interior compartment therein, said housing means including and interior partition dividing said compartment into first and second interior chambers, said interior partition having a first opening therein providing communication between said first and second chambers, and said housing means having a second opening formed therein and commiunicating with said second chamber;

suction means, filter means and dust receiving means disposed in said first chamber;

said second chamber being free of obstructions;

an elongated flexible suction hose stored within said second chamber, said suction hose having the front end portion thereof projecting outwardly through said second opening, the rear end portion of said hose being associated with said first opening so that said hose communicates with said first chamber, and the intermediate portion of said hose as disposed between the front and rear end portions being stored within said second chamber in a random and non-coiled manner;

connecting means coacting between said interior partition and the rear end portion of said hose for axially anchoring the rear end portion of said hose to said interior partition, said connecting means including rotatable coupling means for permitting the rear end portion of said hose to rotate about its longitudinal axis relative to said interior partition so as to relieve twisting of the hose caused by said random and non-coiled manner of storage; and dirve means for causing said hose to be paid out or hauled in through said second opening, said drive means including a drive motor drivingly connected to a first reversible rotatable roller rotatably supported adjacent said second opening and positioned for engagement with said hose for causing said hose to be paid out or hauled in through said second opening depending upon the direction of rotation of said roller, said drive means including a second reversible rotatable roller disposed opposite said first roller so that the hose is held between said rollers.

2. In a suction cleaner according to claim 1 wherein said drive means includes a second roller disposed opposite the first-mentioned roller so that the hose is held between said rollers.

3. In a suction cleaner according to claim 2 wherein said motor is reversible for controlling the rotational direction of said first-mentioned roller.

4. In a suction cleaner according to claim 1 wherein said hose has electrical conductor means mounted thereon and extending along the length thereof, switch means mounted on said hose adjacent the front end portion thereof and connected to said electrical conductor means, said rotary coupling means including an annular portion fixed to the rear end portion of said hose and a support portion fixed to said interior partition and rotatably containing said annular portion, first electrical contact means mounted on said annular portion and interconnected to said conductor means, and second electrical contact means mounted on said support portion and disposed for engagement with said first contact means, one of said first and second contact means including an annular contact ring concentric with said hose so as to permit the first and second contact means to remain electrically connected irrespective of rotation of the rear end portion of the hose.

5. In a suction cleaner, the combination comprising:

housing means defining a compartment therein, said housing means including an interior partition dividing said compartment into first and second chambers, said interior partition having a first opening therein providing communication between said first and second chambers, and said housing means having a second opening formed therein and communicating with said second chamber;

suction means, filter means and dust receiving means disposed in said first chamber;

an elongated flexible suction hose stored within said second chamber in a random manner, said suction hose having the front end portion thereof projecting outwardly through said second opening, the rear end portion of said hose being associated with said first opening so that said hose communicates with said first chamber;

connecting means coacting between said inerior partition and the rear end portion of said hose for axially anchoring the rear end portion of said hose to said interior partition;

drive means for causing said hose to be paid out or hauled in through said second opening, said drive means including a drive motor drivingly connected to a reversible rotatable roller rotatably supported adjacent said second opening and positioned for engagement with said hose for causing said hose to be paid out or hauled in through said second opening depending upon the direction of rotation of said roller; and first and second electrical lead wires provided on the hose along the length thereof, switch means mounted on the hose adjacent the front end portion thereof and connected to the front ends of said first and second lead wires, the rear ends of said lead wires being correspondingly connected to first and second ones of a first pair of electrical contacts which are mounted on said hose adjacent the rear end portion thereof, the rear end portion of said hose being rotatable relative to said interior partition so that said first pair of contacts are movable relative to said interior partition, a second pair of contacts provided on said interior partition and disposed for continuous engagement with said first pair of contacts, and circuitry means electrically connecting said second pair of contacts to said drive motor and said suction means.

* * * * *

UNITED STATES PATENT AND TRADEMARK OFFICE

CERTIFICATE OF CORRECTION

PATENT NO. : 3 958 297

DATED : May 25, 1976

INVENTOR(S) : Hiroshi Hukuba et al

It is certified that error appears in the above-identified patent and that said Letters Patent are hereby corrected as shown below:

Column 4, line 14; change "and interior" to ---an interior---.

Column 4, line 20; change "commiunicating" to ---communicating---.

Column 4, line 44; change "dirve means" to ---drive means---.

Column 4, line 56; change "claim 1" to ---claim 5---.

Column 6, line 1; change "inerior" to ---interior---.

Column 6, lines 17 and 18; change "of said first and second lead wires" to ---of said lead wires---.

Column 6, lines 18 and 19; change "of said lead wires" to ---of said first and second lead wires---.

Figure 3 should appear as shown on the attached page.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*